US008402799B2

(12) United States Patent
Victor

(10) Patent No.: US 8,402,799 B2
(45) Date of Patent: Mar. 26, 2013

(54) SECURING SYSTEM AND METHOD

(76) Inventor: Hugh Victor, Huntington Woods, MI (US)

( * ) Notice: Subject to any disclaimer, the term of this patent is extended or adjusted under 35 U.S.C. 154(b) by 153 days.

(21) Appl. No.: 12/776,567

(22) Filed: May 10, 2010

(65) Prior Publication Data

US 2010/0218567 A1 Sep. 2, 2010

Related U.S. Application Data

(62) Division of application No. 11/860,781, filed on Sep. 25, 2007, now Pat. No. 7,730,750, which is a division of application No. 11/011,633, filed on Dec. 14, 2004, now Pat. No. 7,281,397.

(60) Provisional application No. 60/529,959, filed on Dec. 16, 2003.

(51) Int. Cl.
*E05B 69/00* (2006.01)

(52) U.S. Cl. ..... 70/58; 42/70.01; 42/70.07

(58) Field of Classification Search ..... 70/58, 70.07, 70/57.1; 224/912, 913; 206/317; 211/64
See application file for complete search history.

(56) References Cited

U.S. PATENT DOCUMENTS

| | | | | |
|---|---|---|---|---|
| 3,624,945 | A | 12/1971 | Foote | |
| 3,637,180 | A | 1/1972 | Parry | |
| 3,664,163 | A | 5/1972 | Foote | |
| 4,855,713 | A | 8/1989 | Brunius | |
| 4,864,636 | A | 9/1989 | Brunuis | |
| 5,022,534 | A | 6/1991 | Briggs | |
| 5,196,827 | A | 3/1993 | Allen et al. | |
| 5,271,174 | A | 12/1993 | Bentley | |
| 5,283,971 | A | 2/1994 | Fuller et al. | |
| 5,309,661 | A | 5/1994 | Fuller et al. | |
| 5,392,551 | A | 2/1995 | Simpson | |
| 5,487,234 | A * | 1/1996 | Dragon | 42/70.07 |
| 5,525,966 | A | 6/1996 | Parish | |
| 5,535,537 | A | 7/1996 | Avganim | |
| 5,561,935 | A | 10/1996 | McCarthy et al. | |
| 5,579,923 | A | 12/1996 | Hemmerlein | |
| 5,621,996 | A | 4/1997 | Mowl, Jr. | |
| 5,638,627 | A | 6/1997 | Klein et al. | |
| 5,720,193 | A | 2/1998 | Dick | |
| 5,761,206 | A | 6/1998 | Kackman | |
| 5,805,063 | A | 9/1998 | Kackman | |
| 5,809,013 | A | 9/1998 | Kackman | |
| 5,832,647 | A | 11/1998 | Ling et al. | |
| 5,887,730 | A | 3/1999 | St. George | |
| 5,899,102 | A | 5/1999 | Ling | |
| 5,918,402 | A | 7/1999 | Weinraub | |
| 5,942,981 | A | 8/1999 | Kackman | |
| 6,209,251 | B1 * | 4/2001 | Avganim | 42/70.07 |
| 6,260,300 | B1 * | 7/2001 | Klebes et al. | 42/70.11 |
| 6,269,575 | B1 | 8/2001 | Chang | |
| 6,308,540 | B1 | 10/2001 | Lee | |
| 6,330,815 | B1 | 12/2001 | Duncan | |

(Continued)

FOREIGN PATENT DOCUMENTS

| | | |
|---|---|---|
| DE | 2614250 | 10/1977 |
| DE | 29921048 | 5/2001 |

OTHER PUBLICATIONS

Office Action dated May 29, 2008, U.S. Appl. No. 11/836,442.

(Continued)

*Primary Examiner* — Kristina Fulton
(74) *Attorney, Agent, or Firm* — The Dobrusin Law Firm, P.C.

(57) ABSTRACT

A securing system and method including an article holder portion having at least two separable portions; a mount portion adapted for carrying at least one of the separable portions of the holder portion; and optionally at least one sensor for monitoring the article and providing an output signal indicative of article tampering.

20 Claims, 8 Drawing Sheets

U.S. PATENT DOCUMENTS

| | | | | |
|---|---|---|---|---|
| 6,339,892 | B1 | 1/2002 | Ramos | |
| 6,389,726 | B1 | 5/2002 | Bentley | |
| 6,429,769 | B1 | 8/2002 | Fulgueira | |
| 6,474,238 | B1 | 11/2002 | Weinraub | |
| 6,578,393 | B2 * | 6/2003 | Yarborought | 70/56 |
| 6,601,332 | B1 | 8/2003 | Riebling | |
| 6,722,071 | B1 | 4/2004 | Lin | |
| 7,047,774 | B1 * | 5/2006 | Gogel | 70/32 |
| 7,116,224 | B2 * | 10/2006 | Mickler | 340/568.1 |
| 7,131,300 | B1 * | 11/2006 | Monasco | 70/55 |
| 7,281,397 | B2 | 10/2007 | Victor | |
| 7,367,150 | B2 | 5/2008 | Farchione et al. | |
| 2002/0069569 | A1 | 6/2002 | Riebling et al. | |
| 2003/0213273 | A1 | 11/2003 | Vercoe | |
| 2004/0090153 | A1 | 5/2004 | Touzani | |
| 2005/0229654 | A1 | 10/2005 | Victor | |
| 2006/0112605 | A1 | 6/2006 | Sopko | |
| 2006/0117633 | A1 | 6/2006 | Chang | |
| 2007/0051026 | A1 | 3/2007 | Vor Keller | |

OTHER PUBLICATIONS

International Search report dated May 6, 2005. PCT/US04/041862.

"Recessed Micro Door/Window Sensor" Document No. 466-1502 Rev. C~May 2000.

Master Lock~http://www.masterlock.com.cgi-bin/class_search.pl~Product No. 90,94.

Master Lock~http://www.masterlock.com/cgi-bin/class_search.pl~Product No. 106.

Copending U.S. Appl. No. 11/836,422, filed Aug. 9, 2007.

Co-pending Office Action, mailed Nov. 24, 2010, U.S. Appl. No. 12/537,590.

Recessed Micro Door/Window Sensor Document No. 466-1502 Rev. C May 2000.

Co-pending Office Action mailed Apr. 26, 2011, U.S. Appl. No. 12/537,590.

* cited by examiner

SECURING SYSTEM AND METHOD

CLAIM OF PRIORITY

This application is a division of Ser. No. 11/860,781, filed on Sep. 25, 2007, and Ser. No. 11/011,633, filed on Dec. 14, 2004, which claims the benefit of provisional application Ser. No. 60/529,959, filed on Dec. 16, 2003, all of which are hereby incorporated by reference.

TECHNICAL FIELD

The present invention relates generally to a securing system, and in one particular aspect to a monitored securing system that includes a gun protection feature.

BACKGROUND

In recent years, there has been an increase in the number of jurisdictions that are requiring gun owners to securely stow their weapons when not in use. This has resulted in an increase in the number of locking mechanisms, particularly locks for preventing accidental discharge of weapons. Various commercially available examples of such locking mechanisms currently exist, with many of them functioning by the use of a locking cable, bar or other detent structure that, when attached to the gun, prevents the trigger from being squeezed.

In addition to the foregoing, there have been efforts by some to provide a securing system that includes a feature for particularly storing a weapon. Examples of such systems include those described in U.S. Pat. Nos. 5,196,827; 5,525,966, 5,487,234 and 6,429,769, hereby incorporated by reference.

Nothwithstanding the above efforts, there remains a need for a relatively simple, inexpensive, but effective approach to securing a gun or other device, such as a device that is trigger operated, and particularly an approach that can be readily assimilated into a securing system, such as a residential security system, a commercial security system, a mobile security system or otherwise.

SUMMARY OF THE INVENTION

The present invention meets the above needs by providing a device and method that includes the use of an article holder mechanism having at least two separable portions; a mount portion adapted for carrying at least one of the separable portions of the holder mechanism; optionally at least one sensor for monitoring relative positioning of the at least two separable portions and providing an output signal indicative of the relative positioning; and optionally a securing system in signaling communication with the at least one sensor for receiving the output signal provided from the sensor.

In one particular embodiment of the present invention, the device and method is adapted for use with one or more of a residential security system, a commercial security system, or a mobile security system, and includes the use of a gun trigger detent mechanism having at least two separable portions that are matingly engagable with each other and include a resilient surface in regions that are to be in contact with a portion of a gun; a mounting member adapted for attachment to another structure and carrying at least one of the separable portions of the trigger detent mechanism; at least one battery operated wireless sensor including a first portion including a magnet, and a second portion separable from the first portion, a sensor circuit (e.g., an integrated circuit or circuit board) located in either or both of the first or second portions, the first portion or the second portion being at least partially recessed within the mount portion for monitoring relative positioning of the at least two separable portions and providing an output signal indicative of the relative positioning to a remote location of at least 100 feet; and a securing system in signaling communication with the at least one sensor, the securing system optionally able to be monitored.

DETAIL DESCRIPTION OF THE INVENTION

It should be appreciated that the present invention finds particular suitability in connection with helping to secure firearm weapons against misuse. However, it also has broader application in connection with other systems where it is desired to help secure articles in a fixed location, and/or with respect to some articles, to help prevent trigger actuation of a device, including trigger actuated hand tools or power tools such as saws, drills, mills, nail guns, staple guns, or the like, kitchen utensils, pesticide dispensers, paint or other surface coating sprayers, powered surgical instruments, other fluid dispensers, or the like. Other household, commercial or industrial articles requiring securing (e.g., cutting implements, narcotics, alcoholic beverages, cash, negotiable instruments, securities or otherwise) may also be secured using the present invention, and such articles need not be trigger operated. Further, it should be appreciated that even though the invention is illustrated with particular reference to a residential, commercial or mobile securing system, it is suitable for many other applications. In addition, though in some embodiments the present invention contemplates the installation of complete securing systems that incorporate components of the present invention, it is contemplated that certain existing systems may be retrofitted with a device of the present invention, and such retrofitting is contemplated as within the present invention.

The present invention is premised upon the discovery of a simple yet elegant approach to securing articles, particularly involving a firearm or other trigger operated device safety, pursuant to which there is employed an article securing device including a mount portion adapted to be attached to a support structure; and a removable holder portion separate from the mount portion and adapted to be securingly engaged to the mount portion for assisting in holding an article. At least one of the removable holder portion or mount portion may carry an actuator for allowing the securing engagement.

Figure 1:
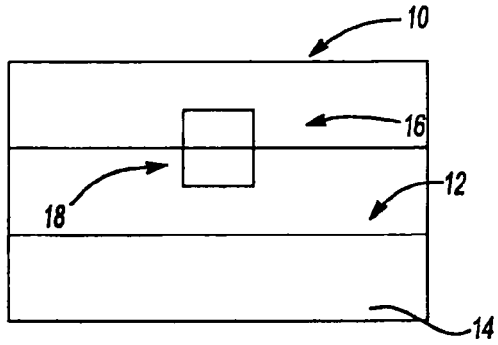
FIG. 1 is a general schematic of a device of the present invention.

Referring first to FIG. 1, there is shown a schematic of one example of a specific class of a sensing trigger lock device 10 in accordance with the present invention. The device 10 includes a mount portion 12, which is adapted to be permanently or temporarily mounted to a support structure 14. In typical applications, the support structure 14 will be selected from one or more of a wall, a floor, a ceiling, a horizontal work surface, a door, a decorative trim panel, a piece of furniture, a storage container, a countertop, a drawer, a stud, a vehicle body in white, a vehicle trim, a vehicle frame, or any combination thereof.

The device also includes a holder portion 16 (e.g., a gun holder portion including a trigger detention mechanism), and an optional sensing portion 18 (e.g., a two-piece separable sensor that communicates a signal when separated). Though shown disposed between the mount portion and the holder portion, a sensor may also be located for detecting removal of the mount point from the support structure.

Figure 2A:
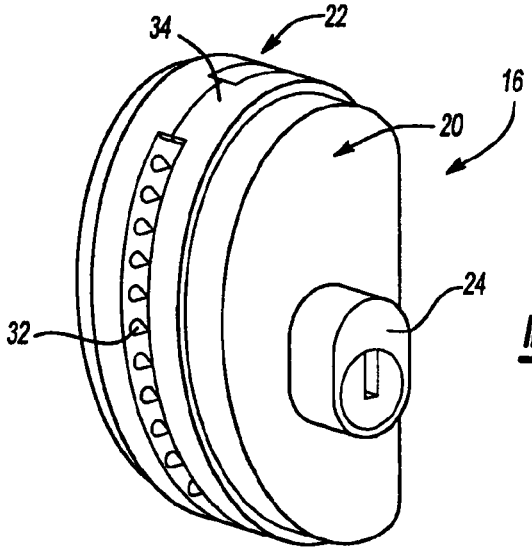
FIGS. 2A and 2B are perspective depictions of a gun holder portion of the present invention.
Figure 2B:
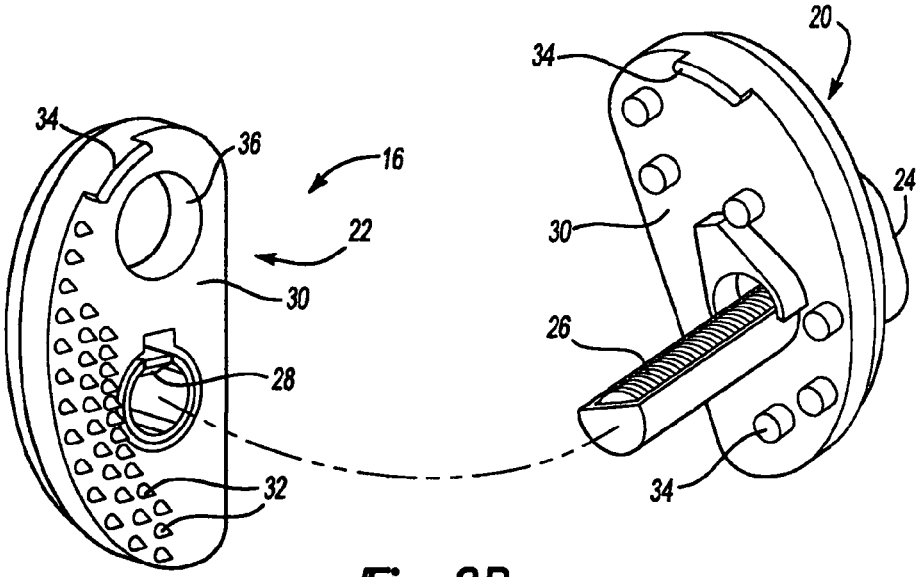

As will be seen with further reference to the illustrated examples herein, and with particular reference to the drawings of FIGS. 2A and 2B, any of a number of different configurations may be employed for the holder portion. For example, one particular approach is to employ a mechanism that includes at least two separable portions defining a detent portion, such as a male component and a female component, the male component being insertable within the female component so that the separable portions are spaced apart relative to each other to flank opposing sides of a gun. The male component, however, is positioned relative to the article (e.g., behind the trigger for a squeeze type trigger) so it is in detent or other engaging relation with it. In this manner, for example, a trigger may be prevented from full depression without separating the separable portions. If desired, either of the two separable portions may form part of the mount portion.

In another approach, the connection need not be of a male/female type, but may instead employ two generally opposing projections that are brought in contact with each other or otherwise in spaced relation, wherein the spacing is smaller than the width of the trigger, or wherein the spacing is larger than the width of the trigger but the distal end of at least one of the projections is offset relative to the axis of rotation of the trigger. Of course, as to the latter, it is also possible to omit one of the projections.

It should be realized that as shown in the drawings herein, the relative positioning of the male and female components may be interchanged. Thus, in some embodiments, it is possible that a male component will be positioned at or as part of the mount portion. In other embodiments, the female component instead will be positioned at or as part of the mount portion. Further, though a number of embodiments herein illustrate a projection of the male component generally perpendicular relative to the mount portion, other orientations are also possible, including at an angle greater than or less than 90 degrees, or generally parallel relative to the mount portion.

The separable portions need not be entirely separable from each other, and thus could include two or more portions that are hinged, tethered or otherwise connected relative to each other. It is contemplated in typical applications that the separable portions that are to come into contact with a trigger operated device will include a relatively soft resilient surface to avoid marring or scratching of the triggered device. This, one embodiment contemplated the use of one or more pads, made of a relatively soft material, such as a plastic (e.g., a polyolefin, a fluorinated polymer (e.g., PTFE), or another plastic), a natural rubber, a synthetic rubber, woven cloth, unwoven cloth, felt, combinations thereof, or the like.

In general, during use to help prevent trigger depression, the detent portion will have the separable portions in locking engagement with each other. Any suitable locking mechanism may be employed ranging from a keyed lock, a combination lock, an electronically controlled lock, an actuatable member (e.g., a latch, a deadbolt, a cam lock, a hook, or the like) such as a solenoid driven member, which is manually actuated or actuated in response to a signal from a touch screen, a key pad, identification badge (including for example cards and tags as well), bar code, visual scan, active or passive radiofrequency identification device (RFID), a biometric scan (e.g., an eye, face, finger, hand or DNA scan) or the like, or some other suitable mechanism.

Examples of mechanisms that could be adapted for use in the present invention include, without limitation, those available from Pro-Lok® under the designation GUNLOK™, those available from Master Lock, under one or more of the designations 940SPT (combination), 90KADSPT (key), 90 (key), or the like. Other examples include those in U.S. Pat. Nos. 6,474,238, 5,918,402, 5,638,627, 5,487,234 or the like, all of which are hereby incorporated by reference. The present invention advantageously contemplates retrofitting one or more components of the above types to form an assembly as described herein. However, independently fabricated structures may also be used.

With particular reference to FIGS. 2A and 2B, a general depiction is shown of a holder portion 16, particularly a trigger lock device, is provided. The device includes a male portion 20 and a female portion 22. A lock 24 or other securing device is provided that allows the portions 20 and 22 to be secured relative to each other, such as by teeth 26 or other engagement structure that are rotatable for engagement with an opposing engagement structure 28. Either or both of the portions might have a coating, pad, layer or other suitable surface 30 for contacting a gun placed between the portions (e.g., a rubber pad). The surface may have one or more textures 32, projections 34 (e.g., for spacing), apertures 36, or a combination thereof. Either or both of the portions may also be adapted to be permanently or removably connected with the mounting portion 12. In one configuration, a rotatable member partially enclosed in a sleeve is employed for defining an engagement structure. In one aspect, it is contemplated that the male or female portion may be removably separable relative to any structure carrying it, and may be replaced with a corresponding male or female portion of different size, shape, material, or combination thereof, thus allowing for customization of the holder portion to suit a particular application.

The mount portion 12 in accordance with the present invention may be any suitable structure that is capable of being temporarily or permanently mounted to the support structure 14, and in a particular aspect of the invention, also is adapted to carry at least part of the sensor portion 18, to carry at least part of the gun holder portion 16 or both.

In general, the structure of the mount portion 12 will be such that it includes a plate or other member 38 having an outer surface 40 that can be mounted flush with an exposed surface 42 of the support structure as shown in the drawings of FIGS. 3 through 8, projecting away from the exposed surface 42 of the support structure 14, recessed below an exposed surface 42 of the support structure 14, or otherwise mounted.

Figure 3:
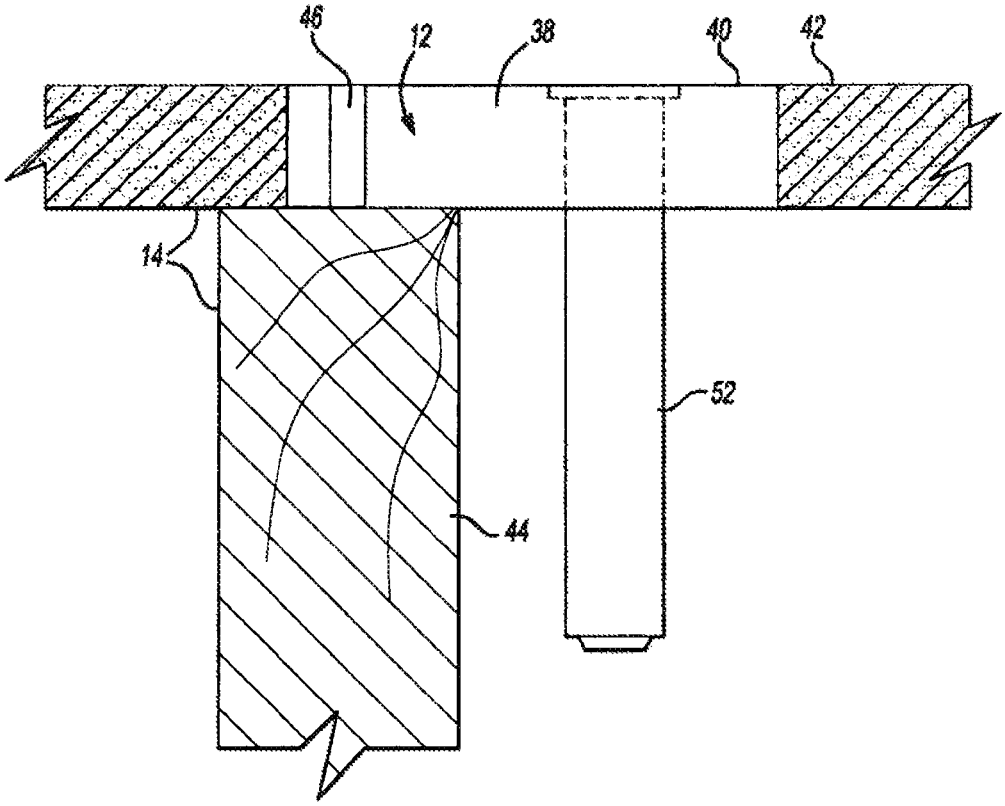
FIGS. 3 and 4 are cut-away views of a mounting portion of the present invention illustrating alternative approaches to mounting the device.

The mount portion 12 may be equipped with one or more suitable brackets, snaps, fasteners or other mounting hardware that will allow the mount portion to be temporarily or permanently mounted relative to the support structure 14 so that the mounting hardware is concealed from view, and is generally inaccessible. As depicted in FIG. 3, the mount portion 12 is adapted for mechanically fastening to a structure such as a wall stud 44. For this, the mounting portion may include one or more apertures 46 for receiving a fastener.

Figure 4:
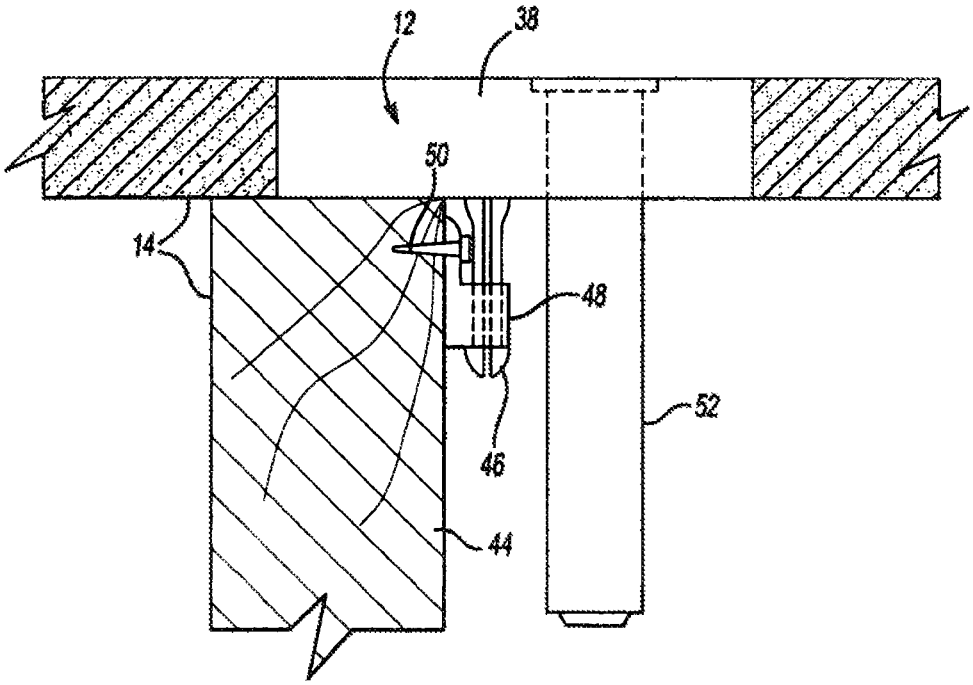

In another embodiment, as seen in FIG. 4, the mount portion 12 might include a male connector portion 46 and with a female connector portion 48 that is mounted to an underlying wall stud (or the male and female portions can be reversed), such as with a suitable fastener 50, an adhesive, combinations thereof or otherwise. The male portion and female portion preferably are structured so that they form a mechanical interlock such as a snap fit or other interference fit, to help prevent withdrawal from the wall. By way of example, the mounting hardware may includes a male projection including at least two spreadable jaws (e.g., spreadable by actuating the separation of the jaws, such as with a key, spreadable by virtue of the intrinsic elasticity of the material, or otherwise) and a female receptacle into which the male projection is securingly insertable. An adhesive may be used in addition to or alternative to a mechanical interlock. Other configurations are also possible and the present is not limited only to a male/female connector.

It should be appreciated that the mount portion 12 in the embodiments disclosed may include or be defined by at least one of the separable portions 20 or 22 of the holder portion 16.

In instances when it is desired that the mount portion 12 is detachable from the support structure 14, suitable hardware may be employed for accomplishing this. For example, as with the trigger detent portion, it may be possible to employ a suitable locking mechanism ranging from a keyed lock, a combination lock, an electronically controlled lock, an actuatable member (such as a latch, a deadbolt, a hook, cam lock or the like) such as a solenoid driven member, which is manually actuated or actuated in response to a signal from a touch screen, a key pad, identification badge (including for example cards and tags as well), bar code, visual scan, active or passive radiofrequency identification device (RFID), a biometric scan (e.g., an eye, face, finger, hand or DNA scan) or the like, or some other suitable mechanism. More specific examples of suitable hardware include recessable or surface mountable cabinet or drawer locks. Thus, it might be possible to mount a magnet beneath the exposed surface of the support structure and attach a solenoid to the mounting portion. Upon energization of the solenoid it can be actuated relative to the magnet for engaging or disengaging the mounting portion 12 from its mounted position. Other arrangements are also possible, as are combinations of two or more temporary or permanent mounting arrangements.

The sensor portion 18 of the present invention may include a wired sensor or a wireless sensor, as desired. A particularly desired approach is to include a wireless sensor.

Typically such sensor will include an integrated circuit chip or other suitable circuitry, a sensing surface in signaling communication with the circuitry, optionally a power source, optionally an antenna, and a separable member such as a magnet, which upon translation away from the sensing surface, will generate and transmit a signal (e.g., a radiofrequency signal, in the case of one illustrative type of a wireless sensor).

Referring to FIGS. 3 through 8, there is shown an example of one type of sensor useful in the present invention, and particularly a sensor having first component 52 and a second component 54. Together the first and second components will house sensor electronics that transmit a signal upon actuation by one of the first or second components. For example, the first sensor component 52 might function as an electronics carrier, and is illustrated as an elongated member, though other geometries may be employed. The second sensor component 54, might function as a signal actuator. For example, it may be a magnet, which is detachable from the first sensor component. In this manner, upon separation of the components, a signal is generated from the sensor.

As can be appreciated, the first and second components can be located relative to the components of the system for which sensing of detachment from the system is desired. For example, either or both of the first and second components might be located adjacent mounting hardware for the mounting portion 12, to sense whether the mounting portion is detached. Either or both of the first and second components might be located in the gun holder portion (e.g., in one or more of the separable portions), the mounting portion 16 or elsewhere. Either or both of the sensing components may be embedded entirely or partially within any other component, or may have a portion thereof exposed.

In one particular example of a sensor 18, the sensor is employed with a compatible processor associated with a control panel of the system, so that the control panel can learn the identity of the sensor, such as is disclosed in U.S. Pat. No. 4,855,713 (incorporated by reference). Accordingly, the sensor might include an electrically eraseable memory containing signal conditioning data and a pseudo randomly programmed identification code. In this manner, the processor can establish an identity code table permitting later transmissions by the device to be confirmed as belonging to the system. The sensor may be capable of transmitting message packets, in accordance with the teachings of U.S. Pat. Nos. 5,805,063, 5,761,206 or both (incorporated by reference), or possibly with suitable measures taken for energy conservation, such as controlling the number of redundant message packets, in accordance with the teachings of U.S. Pat. Nos. 5,809,013, 5,942,981 or both (incorporated by reference).

Any of a number of sensors are suitable for use in the present invention, including crystal controlled radiofrequency transmitters. See, e.g., U.S. Pat. No. 4,864,636 (incorporated by reference). Examples of commercially available sensors include those offered as "Recessed Micro Door/Window Sensor" from Interactive Technologies, Inc. (e.g., ITI Part Nos. 60-741-95 or 60-741-11-95).

A single sensor might be used. A plurality of the same or different sensors might be used. An array of sensors might be used with sensors in the array being the same or different relative to each other, but carried via a common carrier. An example of one type of array of force sensors is discussed in U.S. Pat. No. 5,196,827 (incorporated by reference). Thermal detection, optical or other forms of motion or proximity sensors might be employed in addition to or as an alternative to the above sensors, such as an infrared detector that senses the presence of a person in its proximity, and transmits a signal for triggering an alarm or for attracting attention of a remote monitor or both.

It should be appreciated that one or more of the sensor portion 18, the gun holder portion 16, and the mount portion may each be separate structures, or they may be integrated with each other so that the functions of each are performed with fewer parts. To illustrate, mount portion 12 may consist essentially of a single integrated piece structure or include a plural piece structure, that is attachable to the support structure 14 using at least one fastener, adhesive, weld, mechanical interlock, latch, hook, dead bolt lock, cam lock or any combination thereof.

Figure 5:
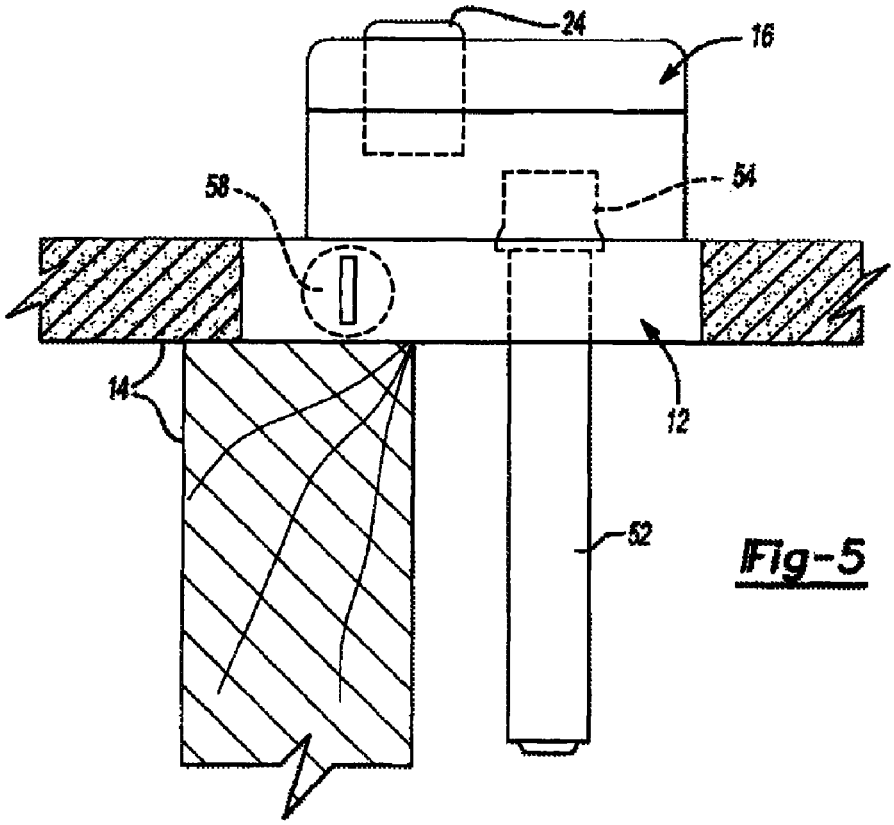
FIGS. 5 through 8 are cut-away views of a device of the present invention illustrating alternative approaches to assembling the device.
Figure 6:
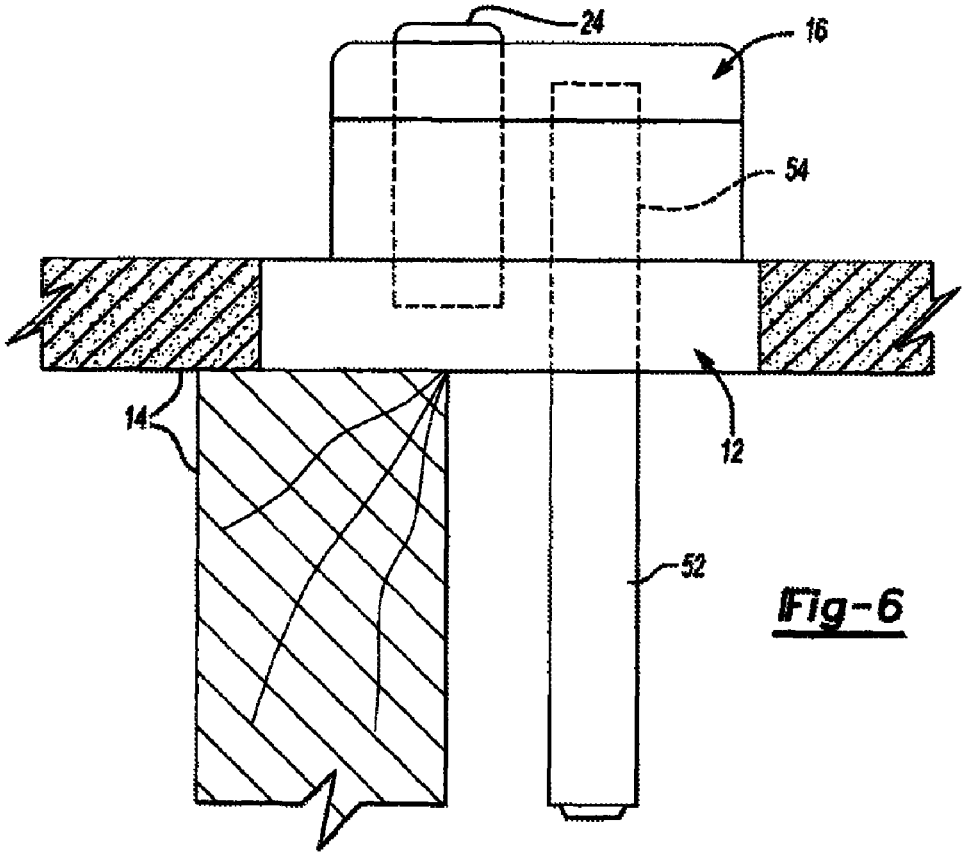
Figure 7:
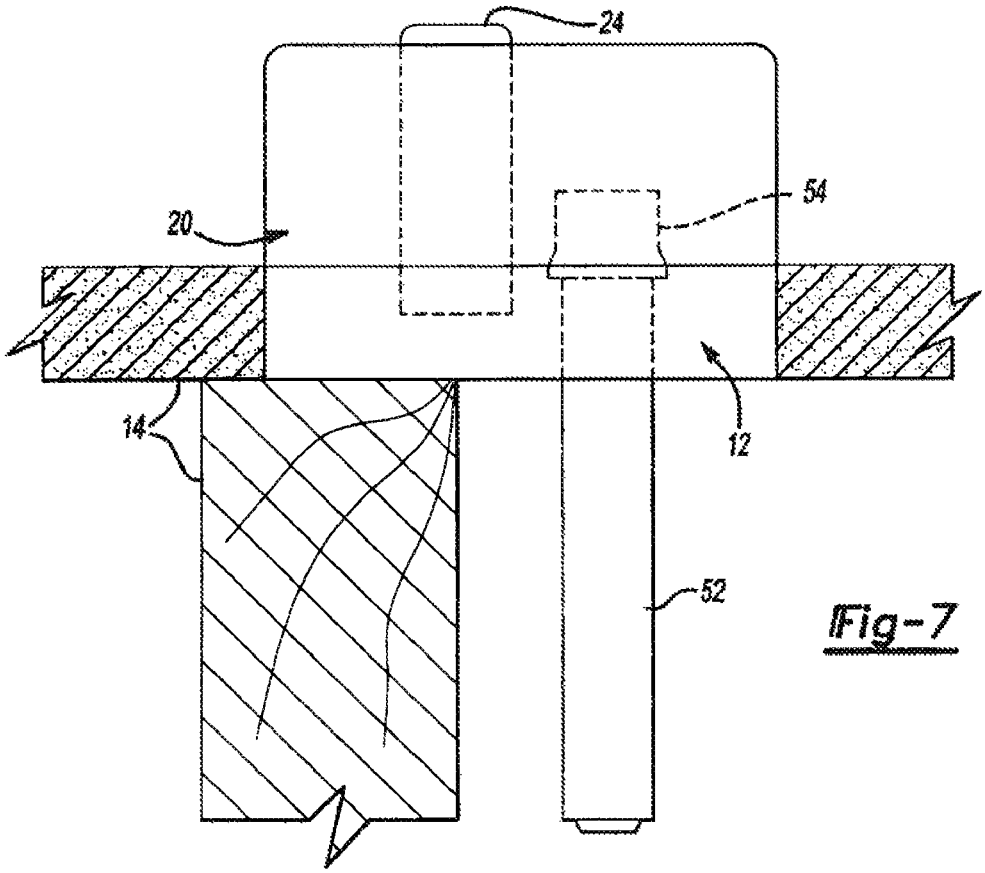
Figure 8:
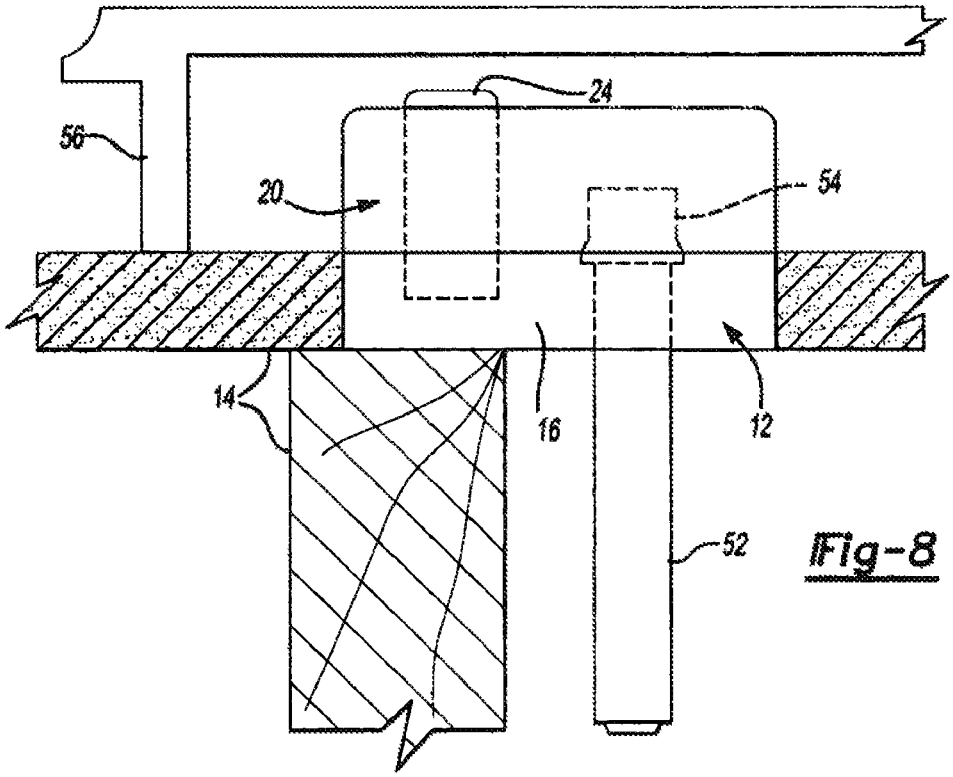

By way of further example, in FIGS. 5 and 6, the gun holder portion includes plural separable components that are separable from the mounting portion 12. In FIGS. 7 and 8, the mounting portion 12 defines one of the separable portions of the gun holder portion 16. As also illustrated in FIGS. 5 through 8, at least one of the sensor components 52, 54 may be positioned in one or more of the separable portions 20 and 22 of the gun holder portion. FIG. 8 further illustrates the use of a cover 56, which can be removably secured over components of the apparatus herein to conceal the components. For example, the cover 56 may be a decorative structure or it may be a camouflaged structure such that it resembles a common household article (such as an art work, a humidor, an ash tray, a temperature control panel, a telephone, a storage container, a book, a food container, a light switch, an electrical outlet, a radio, a television, a computer component or the like). The cover itself might be adapted for transmitting a signal if tampering occurs.

Other variations of the devices herein are also possible. For example, the mounting portion might be adapted to be removable from the support structure 14 to which it is mounted, such as by use of a lock (e.g., a pop-up lock 58 as in FIG. 5). In this manner, the mount portion 12, the holder portion 16 or both can be used in remote locations.

FIGS. 9-15 illustrate additional examples of devices according to the present invention. It should be appreciated that as with other drawings herein, these drawings are not necessarily to scale and are intended as illustrating relative positioning of components. Tolerances, spacings, dimensions, materials or the like may be selected or varied for a particular desired application using art-disclosed techniques. In the drawings of FIGS. 9-15 the same reference numeral is used to denote similar components, as previously employed. Though not shown, it should be realized that similar attachment techniques and hardware may be employed as with the earlier embodiments for securing the mount portion to a support structure.

Figure 9:
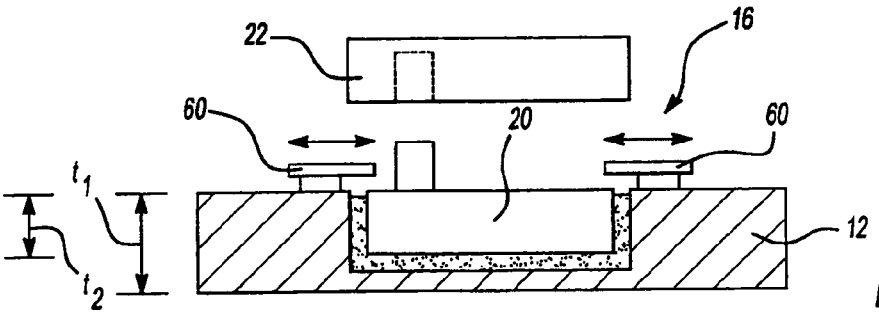
FIGS. 9 through 16 are additional sectional view of alternative assemblies of the present invention.

FIG. 9 thus illustrates a mount portion 12 that includes an opening to receive one of the male component 20, the female component 22 (or both) of the holder portion 16, which is captured by retainer member 60. As with the other devices illustrated, the thickness ($t_1$) of the mount portion need not necessarily be greater than the thickness ($t_2$) of a component of the holder portion. It can also be less than or equal to it. In FIG. 9 there are schematically shown a plurality of tongues or other suitable member as the retainer member 60, which are translatable (e.g., laterally as shown, hingedly, or otherwise) as desired (e.g., by way of a locking operation) to allow securing or removal of a component of the holder portion 16 from the mount portion 12. Another embodiment contemplates use of only a single such translatable member.

Figure 10:
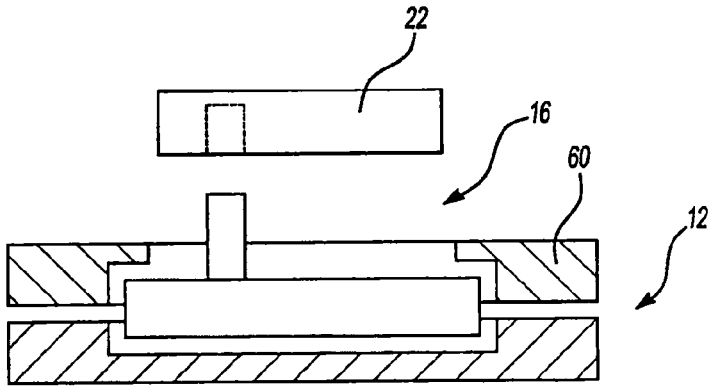

Another embodiment employing a retainer member that effectively captures a component of the holder portion beneath its surface is shown in FIG. 10, where the retainer member 60 is effectively a detachable portion associated with the mount portion 12.

Figure 11:
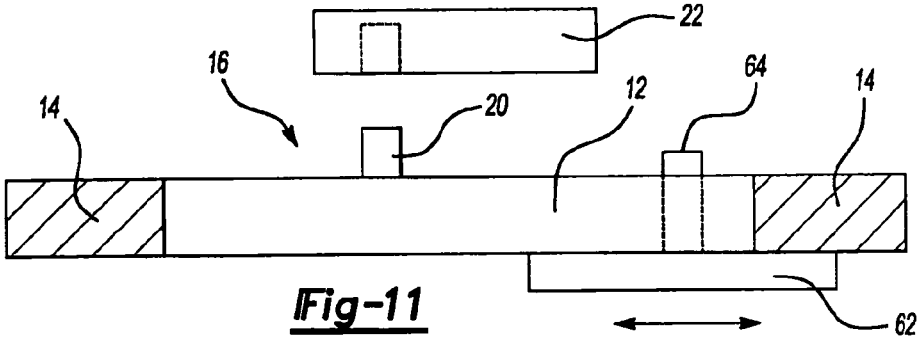

FIG. 11 shows the use of a member 62 that is actuatable with an actuator 64 (e.g., a key, a combination, or otherwise) into and out of engagement with a corresponding recess or other suitable structure formed in or attached to the support structure 14 to enable the mount portion to resist pull-through. In this embodiment it is also illustrated how one of the holder portion components 20, 22 can be integrated into the mount portion 12. It should be realized, of course, that such feature is not necessarily unique to the configuration only of FIG. 11, but may be employed in the other embodiments shown. Likewise, a securing structure using a member such as member 62 can be used in the other embodiments as well.

Figure 12:
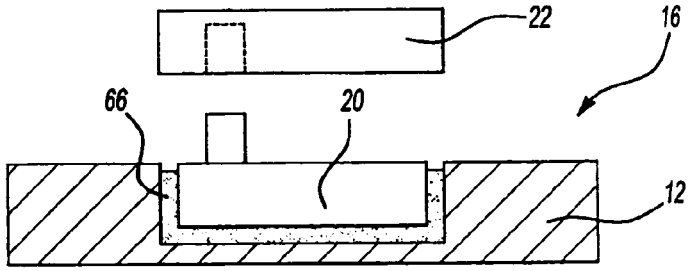
Figure 13:
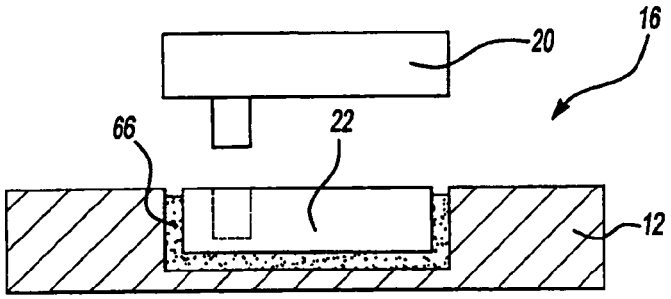

FIGS. 12 and 13 illustrate interchangeability of holder portion components 20, 22, and also illustrates the optional use of an adhesive 66 (or other attachment mechanism) to temporarily or permanently secure the component to the mount portion 12.

Figure 14:
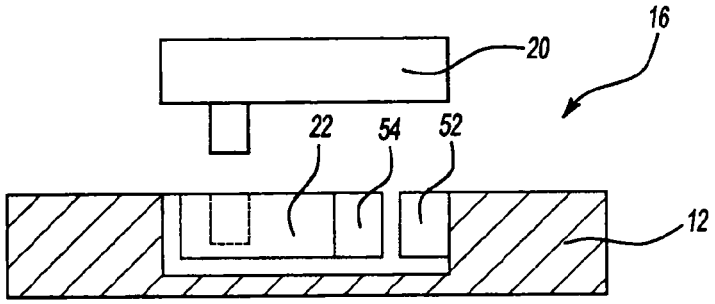
Figure 15:
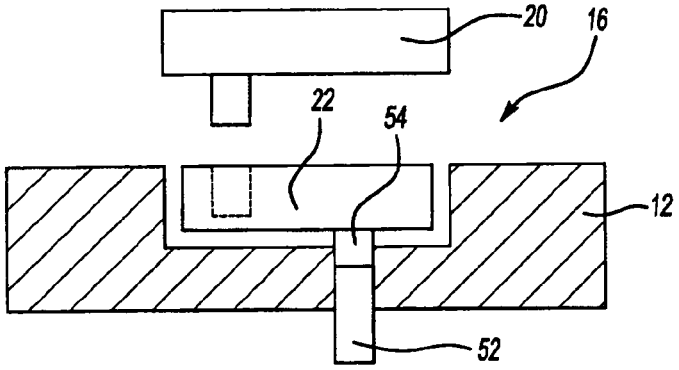

FIGS. 14 and 15 illustrate alternative sensor positions that might be employed for sensor components 52 and 54 when a sensor is used.

Figure 16:
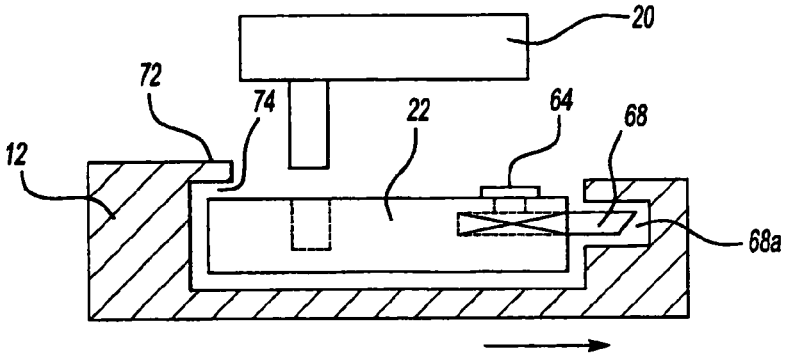

FIG. 16 illustrates an example of an embodiment that includes at least one member 68 (e.g., a deadbolt, tongue, or the like) for securingly engaging at least one of the holder portion components 20, 22 to the mount portion 12. In this embodiment, the member is spring biased outwardly (in the direction of the arrow) member and has at least one chamfered (whether flat, curved or otherwise) surface 68*a*. This allows a user to engage the mount portion with the support structure by pushing the mount toward the support structure. Upon contacting an engaging surface, the member 68 will be depressed (e.g., opposite the arrow direction), but will be biased to a locking position once the member is securely located. It is possible, as with the other embodiments herein to locate the member external of the mount portion (e.g., in a bracket that is part of the mount portion but separable therefrom, in the support structure or otherwise) for detent engagement with the mount portion. FIG. 16 shows a single member for locating in a structure having a flange 72 defining an undercut region 74 into which the mount portion might be placed prior to securing it with the member 68. It is also possible to omit such a structure and employ a hinge along that side, or possibly even employ at least one additional member such as member 68, to help resist pull-through of the component 22. An actuator 64 as previously described may be used to actuate the member 68.

Figure 17:
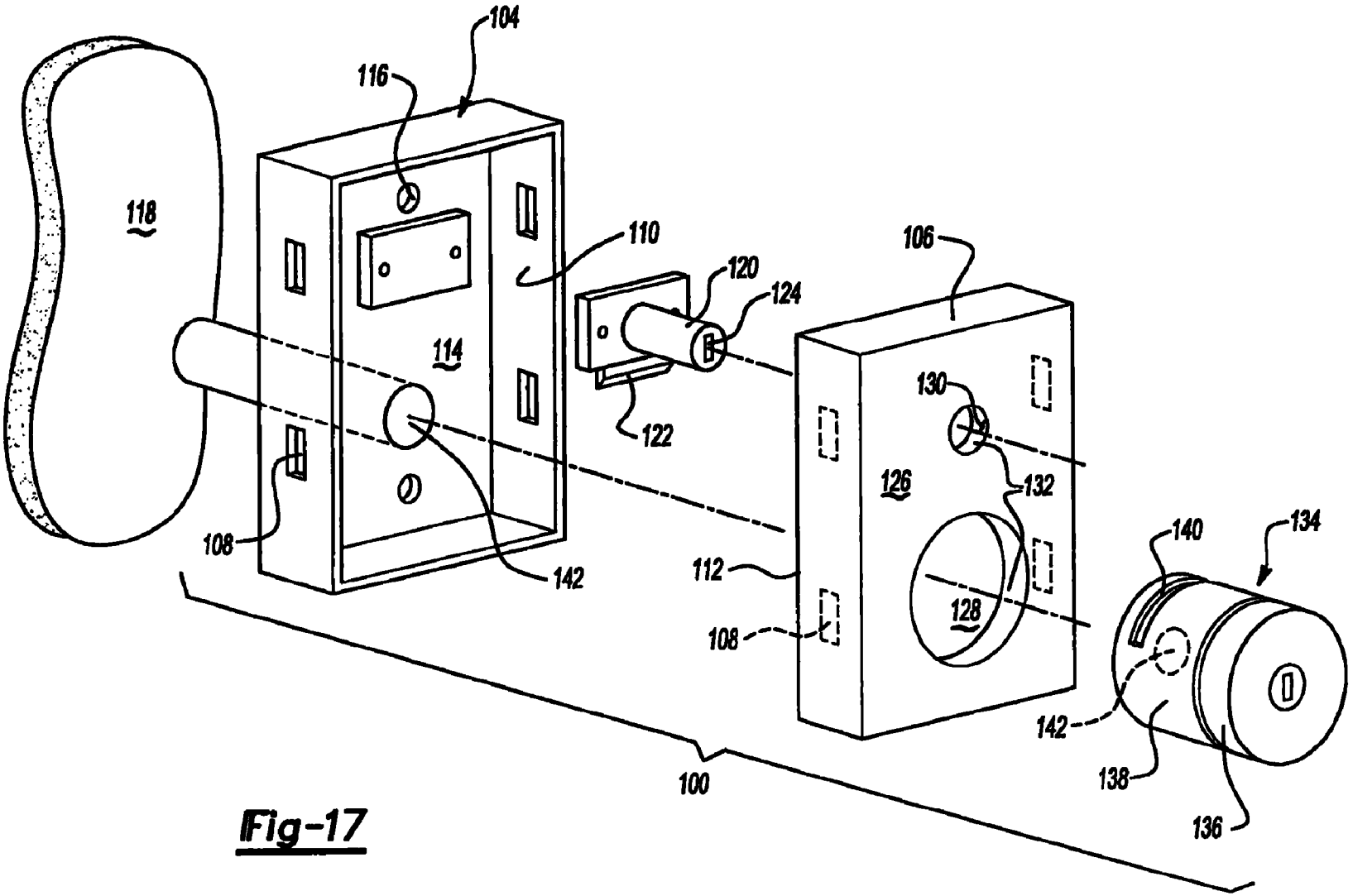
FIGS. 17 and 18 are views of another securing system of the present invention.

Referring also to FIG. 17, another embodiment of a securing device 100 of the present invention is illustrated. In this embodiment, the device includes a mount portion 102 having a first portion 104 and a second portion 106, wherein the first and second portions are adapted to engage each other and optionally form an enclosure therebetween. Advantageously, this provides protection to any components located within the enclosure by concealing or encasing the components. Accordingly, the first or second portion is adapted to cover at least a portion of the other first or second portion. For example, the first portion, second portion or both may include attachment features 108 for releasable or permanent attachment of the first and second portions. Suitable attachment features includes snap-fit configurations, hook and latch configurations, fasteners, friction fit, adhesives, locking members or otherwise. Advantageously, the first and/or second portions may also include wall portions 110, 112 for facilitating in the joining of the first and second portions, forming an enclosure, concealing or encasing of the components, combinations thereof or otherwise. However, it should be appreciated that the first and second portions may comprise a single integrated component.

In more detail, the first portion includes a mount member 114 having one or more openings, lugs, or other structure 116 for temporary or permanent attachment of the first portion to a support structure 118, such as the support structures as previously described herein. Advantageously, the mount member may be shaped to correspond to the support structure being mounted to (e.g., flat for a wall portion, or otherwise). For example, the fixture may comprise of one or more holes formed in the mount member for receiving fasteners therethrough. It should be appreciated that other fixture configurations are available.

The first portion may also includes engaging feature 120 for engaging adjacently located members (such as a removable holder or otherwise). Preferably, the engaging feature includes a movable member 122 adapted for retractable movement relative to (e.g., perpendicular to) the mount member. A preferred moveable member is adapted to create a binding relationship with a member, in at least one direction, which is adapted for movement perpendicular to the surface of the mount member. As such, referring to FIG. 17, a member may be allowed for movement toward the mount member, but be prevented from moving in an opposite direction, due to the moveable member having a beveled edge on a side opposite of the mount member.

Suitable movable member include any movable member adapted to engage a corresponding structure having a cut-out portion, depression, notch, or the like. By example, in one aspect, a preferred movable member comprises a spring loaded beveled tongue adapted for retracting movement upon application of a force against a beveled surface of the tongue, which is generally perpendicular to the surface of the mount member. Advantageously, the finger is beveled one side to provide a locking relationship. However, it should be appreciated that the tongue may include more than one beveled surface.

At first glance, as depicted, the engaging feature 120 resembles a conventional desk, cabinet or drawer lock; however, the beveled surface is generally opposite the side it is on in such conventional systems. Among its many aspects, the present invention also contemplates the unique structure of such an engaging feature, which may be useful for any of a number of different securing applications, as disclosed herein or otherwise.

Preferably, the engaging feature is located on the mount member, opposite of the side contacting the structural member such that the engaging feature is at least partially located within the first member, as defined by the wall portions 110. However, the engaging feature may also be mounted to the second portion of the mount member and preferably within wall portions 112. Furthermore, it should be appreciated that the engaging feature may be integrated with either the first or second portions. Optionally, the engaging feature may be spatially located from the mount member through a platform, spacer, or the like. Suitable engaging features include any suitable locking mechanism, such as described herein, or otherwise, which includes a moveable member as described above. Advantageously, the engagement feature includes a locking component 124 (e.g., a keypad, key opening, combination pad or other coded configuration as described herein) for controlled movement of the movable member. For example, in a preferred embodiment, the locking component may comprise a deadbolt lock (with a beveled or unbeveled tongue) or the like. Accordingly, the engaging feature may comprise a removable lock for engaging with an adjacent member.

The second portion includes a cover member 126 and extending walls 112, which preferably have a corresponding shape to that of the mounting member of the first portion. Preferably, the walls of the second portion fit about the walls 110 of the first portion such that an enclosure is formed between the first and second portions. However, the walls 112 may also fit within the walls of the first portion 110. In a preferred embodiment, the walls of the first and second portions are attached together through attachment feature108 such that no appreciable gap exists between the walls. Optionally, the walls may form a seal between the enclosed portion of the device and the surrounding area.

The cover member defines a first opening 128 for receiving a member, such as a removable holder (e.g., of a type as in FIGS. 2A and 2B). The cover member may also defines a second opening 130 for receiving a portion of the engagement feature located on first portion. It should be appreciated that when the first and second portions are joined, the engagement feature extends through a portion of the second opening so that any locking component of the engagement feature is accessible. Similarly, upon joining of the first and second portions, the second opening defines a path for insertion of a member to a region adjacent to the moveable member of the engagement feature.

The first and/or second portion may include additional features for joining or guiding features of the securing device together. For example, the second portion may further include a flange 132 or the like, that extends about the circumference of the first and/or second opening and into the formed enclosure. Accordingly, an object inserted through the first or second opening (e.g., engagement feature or otherwise) may be guided to a region adjacent to the movable member of the engagement feature. In this manner, a user has the option of releasably securing an article (e.g., a gun) to a support structure 118, and removing it therefrom while staying attached to the holder and to the portion 106 (with the latter further being adapted for mounting to a portion of a type like portion 104, but which is located remotely relative to portion 104 (such as in a vehicle, or some other location).

The securing device further includes a removable holder portion 134 adapted to attach to a member having a trigger assembly, such as a gun or otherwise. Suitable removable holder portions are as described herein. Accordingly, the holder portion may comprise a first component 136 and second component 138 that are adapted to matingly engage each other and block depression of a trigger. In a preferred embodiment, the first, second or both components are adapted to be placed within the first opening 128 of the second portion 106. More preferably, the first or second components have a cross-sectional shape corresponding to that of the first opening such that the removable holder portion is adapted to slidably move into the first opening and along the flange 132.

Preferably, at least one of the first or second ends, which is inserted into the first opening, is configured with a corresponding engagement feature 140 adapted to matingly engage with the moveable member 122 of engagement feature 120. Accordingly, upon insertion of the first or second component into the mount portion, the engagement feature 140 is advantageously located adjacent to the movable member such that upon extension, the moveable member engages the engagement feature 140 of the holder portion thereby preventing the holder portion from exiting the first opening. Upon retraction of the moveable member 122, the engagement feature 140 is disengaged and the holder portion may be removed from the mount portion. It should be appreciated, that movement of the moveable member 122 may be achieved through a locking component, as described above.

Figure 18:
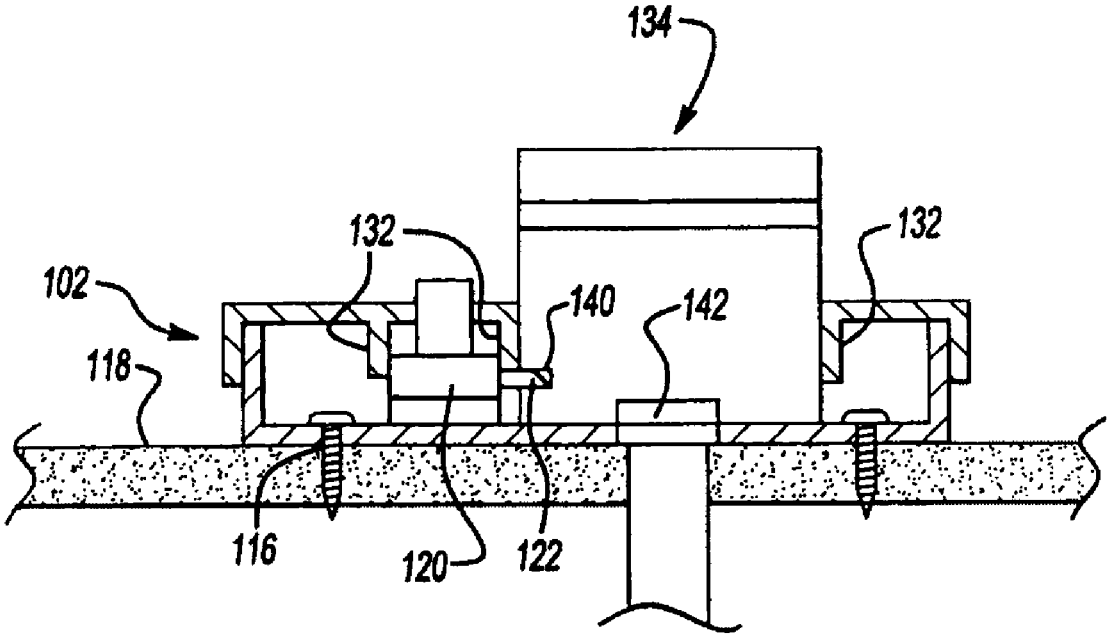

It should be appreciated that the configuration illustrated in FIGS. 17 and 18 may be modified to include other arrangements. Advantageously, this may provide improved access to one or more component of the device including any locking feature or otherwise. For example, while it is illustrated that the engagement feature 120 is located above the removable holder 134, it should be appreciated that the removable holder may be located above the engagement feature. Accordingly, engagement feature 140 may be located on another portion or side of the removable holder. Of course, it should be appreciated that other configurations are available including horizontal spatial arrangement or otherwise.

Optionally, as with other embodiments, the device may be further configured to include a suitable sensor 142 for monitoring the position of the holder portion with respect to the mount portion. It should be appreciated that suitable sensor may include any of the suitable sensors contained herein or otherwise. Accordingly, the placement of the holder portion, and any attached member (e.g., gun or otherwise), may be continuously monitored to insure security of the same.

The device of any of the above examples may be further be modified or include an esthetic design over a portion of the viewable surface and/or is ornamentally shaped. The design may comprise a modification to a surface, material selection (e.g., chrome or otherwise), addition of an ornamental design or otherwise. For example, the second portion, which preferably is located on a side of the device opposite of the structural surface, may include suitable design that is complimentary to the component engaged by the holder portion, or otherwise. Suitable designs include brushed or polished Aluminum, leather, carbon fiber or otherwise. In another example, the device may be ornamentally shaped to correspond or otherwise be associated with the member secured thereto (e.g., a gun or otherwise). Other design configurations should be appreciated.

It will be appreciated from the above that operation of the system of the invention is effected by separating the separable portions of the holder portion and placing a gun or other trigger operated device or article between the portions. The portions of the holder portion are then secured relative to each other, and preferably in trigger detenting relation, such as by locking the portions. The holder portion, in turn, is secured to a support structure by way of the mount portion. The sensor components, if and when employed, are positioned proximate each other and in any suitable manner such that if one component becomes separated from the other or otherwise trips an actuation signal, the electronics of the sensor component will transmit a signal. Thus in a particularly preferred aspect, it will be appreciated that removal of an article by removal of the holder portion, the mount portion, or both will separate a magnet of the sensor and actuate the sensor to transmit a signal. In one aspect, the signal may be remotely monitored. In another aspect the sensor may be equipped with a timer that delays transmission of a signal, that transmits a signal in response to actuation of a panic switch, or a combination thereof. A thermal detection sensor may alternatively be employed, where the body heat that is detected, such as by an infrared detector will cause transmission of a signal.

The present invention may be adapted for use in any of a number of different ways. An alarm system may employ a sensing lock device in accordance with the present invention. The device may be in wired or wireless signaling communication with at least one receiver located on the same premises or different premises as the sensing lock device. Upon activation by a signal received from the sensing lock device, the receiver sounds an audible alarm, emits a visual alarm signal, transmits a signal to a remote monitoring station, or a combination of two or more thereof. The sensing lock device may be employed in an alarm or other system that includes one or more other features selected from an intrusion detection system, a fire detection system, a smoke detection system, a fire suppression system, a medical emergency alert system, a video surveillance system, an audio surveillance system, a chemical detection system, a gas detection system (e.g., sulfur dioxide, carbon monoxide, nitrous oxide, carbon dioxide, oxygen, etc.), a temperature detection system, a proximity sensor, a fluid level detection system (e.g., a water level sensor), a power loss detection system, a global positioning system, any combination thereof or the like. For example, in accordance with teachings of U.S. Pat. No. 6,429,769 (incorporated by reference), the system may be configured so that in the event of theft of a gun or other article being secured by a system of the present invention, the gun or article will have a transmitter attached to or otherwise incorporated in it that will enable the gun or article to be tracked by a GPS. The sensing lock device itself may house an audible or visual alarm signal, or both. It may also integrate the receiver therein or be in signaling communication with a remote receiver.

It is thus also contemplated as within the present invention a method that includes monitoring the sensing lock device from a remote location, such as by a residential, home or automobile security services entity, and in accordance with a service plan or subscription service. The method alternatively or additionally may employ a step of certifying the use by a consumer of the sensing trigger lock device to a law enforcement agency, an insurance company, or to some other third party that has an interest in confirming the securing of a weapon or other trigger operated device. For example, an entity might offer an incentive to purchase goods or services (e.g., a discount or other incentive selected from a discount on system installation service fees, a discount on hardware purchase or lease price, a discount on insurance rates, a discount on price of monitoring services, or any combination thereof) to a consumer who installs or otherwise uses an article securing device, in order to provide incentives for their use. Another method contemplates that a weapons or other goods manufacturer will offer for purchase or use an article securing device of the present invention to a customer who purchases an item to be secured with the device.

The device of the present invention may be made of any suitable material or combination of materials. In one aspect of the invention, the device or at least a portion thereof is fabricated from a material that is relatively tough, such as an aramid fiber, carbon fiber, fiber reinforced composite, a metal, a thermoset plastic (e.g., an epoxy, a polyurethane, a polyester, etc.), a thermoplastic (e.g., a polyolefin, a poly(meth) acrylate, a polyamide, a polycarbonate, etc.) combinations thereof or the like.

Adhesives suitable for use herein, preferably though not necessarily, are structural adhesives, and optionally may be a room temperature cure adhesive, a moisture cured adhesive, a heat cured adhesive, a radiation cured adhesive or a combination thereof. Other adhesives may also be used, such as a hot melt adhesive. Accordingly, adhesive types are preferably selected from epoxies, urethanes, acrylics, vinyl acetates, combinations thereof or the like.

Devices of the invention may be used in residential homes, in commercial buildings, in stores, in lockers, in law enforcement weapon storage facilities, in military weapon storage facilities, in mobile vehicles, aboard aircraft or elsewhere. Devices may be configured for mounting to a wall, to the top of a horizontal surface (e.g., a countertop or shelf), to the bottom of a horizontal surface, to a post, inside a cabinet, inside a closet, to a floor, beneath a floor, to a stair, within a well, tank or other fluid reservoir, in a drawer, combinations of two or more thereof or otherwise. Uses of the devices according to the above are thus also considered part of the inventive features of the present invention.

It will be further appreciated that functions or structures of a plurality of components or steps may be combined into a single component or step, or the functions or structures of one step or component may be split among plural steps or components. For example, the mount portion might be divided into plural components for performing the functions described. Alternatively, functions performed by one of the components might be split among or performed by other components (e.g., a latch or other member that is disclosed herein as carried by a mount portion might be carried instead by the support structure). The present invention contemplates all of these combinations. Unless stated otherwise, dimensions and geometries of the various structures depicted herein are not intended to be restrictive of the invention, and other dimensions or geometries are possible. In addition, while a feature of the present invention may have been described in the context of only one of the illustrated embodiments, such feature may be combined with one or more other features of other embodiments, for any given application. By way of example, without limitation, the locking arrangement of FIG. 17 may be adapted for any of the other embodiments, the member 68 of FIG. 16 might be employed in any of the earlier described embodiments, the retainer member 60 of FIG. 10, might be used in the alternatively disclosed embodiments, a sensor may be employed in the embodiments where it is not shown in drawings, or omitted from embodiments in which it is shown in drawings, the components 20 and 22 may be reversed, a tapered or other chamfered surface may be employed on members in embodiments where shown as constant cross section, or a constant cross section employed where shown as chamfered, the cover 56 may be used in embodiments where not shown in the drawings, or otherwise. It will also be appreciated from the above that the fabrication of the unique structures herein and the operation thereof also constitute methods in accordance with the present invention.

Reference to "gun holder portion" or other "gun"—specific references are not intended as limiting the invention solely to the use of guns. As discussed, other devices, and particularly trigger actuated devices can be secured using the present invention, with the "gun holder portion" or other "gun"—specific component being adapted for the particular device desired to be secured. Further use of "wireless" refers to the absence of wires as the primary signaling link between devices, and does not preclude the existence of wires contained within a device. Without limitation, wireless devices may upon a form of optical, thermal or other detectable electromagnetic signal to achieve signaling communication. References to "first" or "second" are not intended to exclude the presence of additional components. Nor are they intended necessarily to denote a particular sequence.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

What is claimed is:

1. An gun securing device comprising:

a lock device including:

a) a removable holder portion, removable holder portion including at least two separable portions that include an engagement structure that secures the at, least two separable portions together so that depression of a trigger is prevented;

b) a lock, the lock being located on one of the two separable portions;

c) at least one sensor having a first component and a second component, a mount portion adapted to be attached to a support structure and is independent of the lock device; and wherein the lock device is separable from the mount portion and adapted to be securingly engaged to the mount portion for assisting in holding an article, at least one of the removable holder portion or mount portion carrying an actuator for causing the securing engagement;

wherein the lock device securingly engages the mount portion by way of a lockable mating engagement;

wherein the second sensor component is one of the separable portions lock device and functions as a signal actuator; and wherein the lock device is removable from the mount portion and upon removal prevents trigger depression independent of the mount portion.

2. The securing device of claim 1, wherein the lock is locked by way of a keyed lock, a combination lock, an electronically controlled lock, an actuatable member, or a combination thereof.

3. The securing device according claim 1, wherein the removable holder portion, the mount portion, or both includes at least one sensor for detecting separation of the holder portion from the mount portion.

4. The securing device of claim 3, wherein the at least one sensor is in signaling communication with a monitored securing system.

5. The securing device of claim 1, wherein the mount portion includes at least one removable member adapted for receiving the removable holder portion.

6. A gun securing device, comprising:

a lock device including:

a) a removable holder portion for carrying a gun, the removable holder including at least two separable portions that include art engagement structure that secures the at least two separable portions together so that depression of a trigger is prevented; and b) a lock, the lock being integrally located on one of the two separable portions;

a mount portion adapted to be fixedly attached to a support structure and securingly engage the lock device and is independent of the lock device;

wherein the mount portion forms an opening for receiving at least a portion of the lock device;

an actuator mounted to the removable holder or mount portion for releasably engaging the other of the lock device or mount portion, wherein upon engagement the gun becomes releasably attached to the mount portion;

wherein the lock device further includes an opening for receiving a portion of the actuator;

at least one sensor having a first component and a second component, the second sensor component is one of the separable portions of the lock device;

wherein the lock device securingly engages the mount portion by way of a lockable mating engagement;

wherein the second sensor component functions as a signal actuator; and wherein the lock device is removable from the mount portion and upon removal prevents trigger depression independent of the mount portion.

7. The device. of claim 6, wherein the removable holder portion, the mount portion, or both includes the at least one sensor for detecting separation of the removable holder portion and mount portion.

8. securing device of claim 7, wherein the at least one sensor is in signaling communication with a monitored securing system.

9. The device of claim 6, wherein the amount portion further includes a cover for concealing components of the gun securing device.

10. The device of claim 6, wherein the actuator comprises a keyed lock, a combination lock, an electronically controlled lock or a combination thereof.

11. A gun securing device, comprising:

a lock device including:

a) at least two separable portions that include an engagement structure that secures the at least two separable portions together so that depression of a trigger is prevented, b) a lock integrally located within one of the at least two separable portion;

a mount portion that is independent of the lock device and includes a first portion adapted for carrying the lock device and mounting to a surface, and a second portion for covering at least a portion of the first portion and for providing access to the lock;

a removable holder portion adapted for carrying a gun and blocking depression of the trigger of the gun, the holder portion adapted for engaging the lock and for permitting the holder portion to be detached from the mount portion, for allowing removal of the gun from the holder portion while at least part of the holder portion remains engaged with the mount portion, or both; and at least one sensor having a first component and a second component, wherein the holder portion securingly engages the mount portion by way of a lockable mating engagement;

wherein the second sensor component is one of the separable portions of the lock device and functions as a signal actuator; and wherein the lock device is removable from the mount portion and upon removal prevents trigger depression independent of the mount portion.

12. The device of claim 11, wherein the lock comprises a keyed lock, a combination lock, a deadbolt lock, an electronically controlled look, an actuatable member or a combination thereof.

13. The device of claim 11, wherein the second defines a first opening for receiving a portion of the lock.

14. The device of claim 13, wherein the second portion defines a second opening for receiving a portion of the removable holder portion and the second portion includes walls surrounding the second opening formed in the mount portion for guiding the removable holder to a region adjacent to the first lock.

15. The device of claim 1, wherein the mount portion includes a male connector portion and the support structure includes a female connector portion that prevent the mount portion from being withdrawn from a wall.

16. The device of claim 1, wherein the mount portion includes a first portion and a second portion, and the first portion and the second portion engage each other forming an enclosure therebetween.

17. The device of claim 15, wherein the sensor is a wired sensor or a wireless sensor.

18. The device of claim 16, wherein the first portion includes an engaging feature for engaging the removable holder portion.

19. The device of claim 9, wherein the cover defines a first opening for receiving one of the at least two separable portions so that the at least two separable portions connect though the cover.

20. The device of claim 19, wherein the cover is adapted to transmit a signal if tampering occurs.

* * * * *

UNITED STATES PATENT AND TRADEMARK OFFICE

CERTIFICATE OF CORRECTION

PATENT NO. : 8,402,799 B2
APPLICATION NO. : 12/776567
DATED : March 26, 2013
INVENTOR(S) : Hugh Victor It is certified that error appears in the above-identified patent and that said Letters Patent is hereby corrected as shown below:

In the Claims

Column 13, line 54, Claim 1,
Delete "a) a removable holder portion, removable holder portion"
Insert --a) a removable holder portion, the removable holder portion--

Column 14, line 29, Claim 6,
Delete "portions that include art engagement structure that"
insert --portions that include an engagement structure that--

Signed and Sealed this
Third Day of December, 2013

Margaret A. Focarino

Margaret A. Focarino
*Commissioner for Patents of the United States Patent and Trademark Office*